US008342576B2

(12) United States Patent
Eschbach et al.

(10) Patent No.: US 8,342,576 B2
(45) Date of Patent: Jan. 1, 2013

(54) METHOD AND SYSTEM OF PRINTING A SCRATCH-OFF DOCUMENT

(75) Inventors: Reiner Eschbach, Webster, NY (US); David A. Mantell, Rochester, NY (US); Paul J. McConville, Webster, NY (US); Jason O'Neil, Rochester, NY (US); Trevor J. Snyder, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 411 days.

(21) Appl. No.: 12/658,325

(22) Filed: Feb. 9, 2010

(65) Prior Publication Data

US 2011/0193336 A1 Aug. 11, 2011

(51) Int. Cl.
*B42D 15/00* (2006.01)

(52) U.S. Cl. ..... 283/102; 283/100; 283/901; 283/903

(58) Field of Classification Search ..... 283/102, 283/901, 903, 100
See application file for complete search history.

(56) References Cited

U.S. PATENT DOCUMENTS

| | | | | |
|---|---|---|---|---|
| 4,095,824 | A | 6/1978 | Bachman | |
| 4,241,942 | A | 12/1980 | Bachman | |
| 4,254,207 | A | 3/1981 | Landoll et al. | |
| 4,385,107 | A | 5/1983 | Tanaka et al. | |
| 4,543,313 | A | 9/1985 | Mahabadi et al. | |
| 4,891,293 | A | 1/1990 | Sacripante et al. | |
| 4,952,477 | A | 8/1990 | Fuller et al. | |
| 4,973,539 | A | 11/1990 | Sacripante et al. | |
| 4,990,424 | A | 2/1991 | Van Dusen et al. | |
| 5,057,392 | A | 10/1991 | McCabe et al. | |
| 5,147,747 | A | 9/1992 | Wilson et al. | |
| 5,166,026 | A | 11/1992 | Fuller et al. | |
| 5,205,211 | A * | 4/1993 | Edwards | 101/171 |
| 5,215,576 | A | 6/1993 | Carrick | |
| 5,228,692 | A | 7/1993 | Carrick et al. | |
| 5,346,258 | A | 9/1994 | Behm et al. | |

(Continued)

FOREIGN PATENT DOCUMENTS

GB 1 214 329 A 2/1970

(Continued)

OTHER PUBLICATIONS http://www.oberthurusa.com/whitepapers-ensuring.asp; Ensuring It Is All 'Up to Scratch' Oberthur Card Systems Talks of Its' Innovative Printing Techniques for Prepare Mobile Phone Cards; printed Oct. 10, 2006: 4 pp.

(Continued)

*Primary Examiner* — Dana Ross
*Assistant Examiner* — Robert Lichter
(74) *Attorney, Agent, or Firm* — Fox Rothschild LLP

(57) ABSTRACT

A scratch-off document may include a substrate bearing a toner image and a scratch-off layer covering the printed content. The scratch-off layer may include a mass of a first solid ink and a mass of a second solid ink printed over the first solid ink in a distraction pattern. The toner image is formed of a toner that adheres to the substrate, while the scratch-off layer is made of a wax-based or other solid ink that may be removed from the substrate by scratching without removing the toner image. The distraction pattern includes varying pile heights that distract a viewer from any pile height variations that may exist in the toner image.

20 Claims, 7 Drawing Sheets

U.S. PATENT DOCUMENTS

| | | | | |
|---|---|---|---|---|
| 5,532,046 | A | | 7/1996 | Rich et al. |
| 5,542,710 | A | | 8/1996 | Silverschotz et al. |
| 5,599,046 | A | * | 2/1997 | Behm et al. ..... 283/83 |
| 5,601,887 | A | | 2/1997 | Rich et al. |
| 5,667,250 | A | * | 9/1997 | Behm et al. ..... 283/102 |
| 5,704,647 | A | | 1/1998 | Desbiens |
| 5,769,458 | A | | 6/1998 | Carides et al. |
| 5,803,504 | A | | 9/1998 | Deshiens et al. |
| 6,017,671 | A | | 1/2000 | Sacripante et al. |
| 6,152,029 | A | | 11/2000 | Templeton |
| 6,155,491 | A | | 12/2000 | Dueker et al. |
| 6,306,203 | B1 | | 10/2001 | Malhotra et al. |
| 6,379,742 | B1 | | 4/2002 | Behm et al. |
| 6,383,205 | B1 | | 5/2002 | Samson et al. |
| 6,405,929 | B1 | | 6/2002 | Ehrhart et al. |
| 6,413,691 | B2 | | 7/2002 | Daimon et al. |
| 6,419,157 | B1 | | 7/2002 | Ehrhart et al. |
| 6,500,594 | B2 | | 12/2002 | Hamano et al. |
| 6,582,896 | B1 | | 6/2003 | Ito et al. |
| 6,607,864 | B2 | | 8/2003 | Serizawa et al. |
| 6,752,319 | B2 | | 6/2004 | Ehrhart et al. |
| 6,873,821 | B2 | | 3/2005 | Russel et al. |
| 6,875,105 | B1 | | 4/2005 | Behm et al. |
| 6,906,118 | B2 | | 6/2005 | Goodbrand et al. |
| 6,939,627 | B2 | * | 9/2005 | Morizumi et al. ..... 428/41.1 |
| 7,303,134 | B2 | | 12/2007 | Ehrhart et al. |
| 2002/0047259 | A1 | | 4/2002 | Lambert et al. |
| 2004/0142266 | A1 | | 7/2004 | Sacripante et al. |
| 2005/0141942 | A1 | | 6/2005 | Someno |
| 2006/0132570 | A1 | | 6/2006 | Odell et al. |
| 2007/0281224 | A1 | | 12/2007 | Kirk et al. |
| 2008/0131176 | A1 | | 6/2008 | Snyder |
| 2008/0302263 | A1 | | 12/2008 | Eschbach et al. |
| 2008/0304696 | A1 | | 12/2008 | Eschbach et al. |
| 2009/0262400 | A1 | | 10/2009 | Eschbach et al. |
| 2009/0263583 | A1 | | 10/2009 | Mantell et al. |

FOREIGN PATENT DOCUMENTS

| | | | |
|---|---|---|---|
| JP | 10157360 | A | 6/1998 |

OTHER PUBLICATIONS http://www.answerbag.com/q_view.php/16009; What is the silver stuff they use on scratch-off cards and lottery tickets?, printed Oct. 10, 2006: 3 pp.

http://www.answerbag.com/q_view.php/24557; How are scratch-off lottery tickets made?, printed Oct. 10, 2006: 2 pp.

http://www.xerox.com/go/xrx/igen/iGen,jsp?Xcentry=USA&Xlang=en_US&metrics=notrack; The Xerox DocuColor iGen 3. The next wave of digital production printing. Xerox iGen3(TM) Business, printed Mar. 16, 2006: 1 p.

http://www.xerox.com/go/xrx/equipment/product_details.jsp?prodID=DocuColor_oGen3& . . . ; Xerox iGen3 (TM) 110 Digital Production Press, printed Mar. 16, 2006: 2 pp.

* cited by examiner

METHOD AND SYSTEM OF PRINTING A SCRATCH-OFF DOCUMENT

CROSS-REFERENCE TO RELATED APPLICATIONS

This patent application is related to co-pending U.S. patent application Ser. No. 12/496,208, the disclosure of which is incorporated herein by reference in its entirety.

BACKGROUND

This application relates to printing scratch-off documents. More specifically, the present disclosure relates to a scratch-off document and method of printing an embedded security code within the scratch-off layer of a document such as an instant lottery ticket, a gift card, or another document having a scratch-off layer.

Scratch-off type documents, such as instant lottery tickets, typically contain printed data on a substrate which is covered by a scratch-off material to hide the printed data. The scratch-off material may be removed by rubbing it with a hard object, such as a coin or fingernail, to reveal the underlying printed data. The scratch-off material, however, must sufficiently adhere to the substrate so that ordinary handling will not remove the scratch-off material.

Producing scratch-off documents involves complex printing applications which require high volume, low cost printing and other areas of variable data such as winning indicia, number marking and bar code generation. Adding to the complexity of manufacturing scratch-off tickets is the need to protect winning tickets from detection. Examples of detection include the ability to read the indicia that the ticket is a winning ticket prior to its purchase. For instance, infrared detection may serve to identify, or read, winning tickets. Another method of detecting a winning ticket includes scratching off the scratch-off material to find the winning ticket and then recoating the material onto the ticket. Unscrupulous individuals may then knowingly sell losing tickets. Such methods of detection are also possible for other value documentation readings having content to be protected, such as bank mailings containing PIN codes.

SUMMARY

Although any methods, materials, and devices similar or equivalent to those described in this document can be used in the practice or testing of embodiments, the preferred methods, materials, and devices are now described. This disclosure is not limited to the particular systems, devices and methods described, as these may vary. Also, the terminology used in this document is only for the purpose of describing particular versions or embodiments, and it is not intended to limit the scope.

As used in the description below and in the appended claims, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" means "including, but not limited to."

In an embodiment, a scratch-off document includes a substrate, a toner layer printed on the substrate, and a scratch-off layer. The toner layer includes a set of first pixels of a toner having a first color, along with a set of second pixels of a toner having a second color. The first set of pixels and the second set of pixels are positioned in a side-by-side relation. The scratch-off layer covering all or a portion of the toner layer, and it includes a first mass of a first solid ink, along with a second mass of a second solid ink printed in a distraction pattern over or under a portion of the first mass. The toner layer may exhibit a property of adhesion to the substrate that is substantially higher than a property of adhesion of the scratch-off layer, such that the scratch-off layer may be removed from the substrate by scratching with a hard object without removing the toner layer.

In various embodiments, the second mass of the scratch-off layer may have an average thickness that is greater than the average thickness of the toner layer, and the first mass may have an average thickness that is at least twice the average thickness of the toner layer. Optionally, the first solid ink may include a non-infrared active ink, the second solid ink may include an infrared active ink, and the distraction pattern may include a security code so that the second solid ink, when exposed to infrared light, displays the security code. Also, the scratch-off layer may be substantially opaque.

In an alternate embodiment, a document includes a substrate, a toner image printed on the substrate, and a substantially opaque solid ink image covering all or a portion of the toner image. The toner image may include pixels of a toner having a first color and pixels of a toner having a second color. The pixels of the first and second colors may be positioned in a side-by-side relation so that the toner image exhibits an average thickness. The solid ink image may be substantially opaque and may include a first mass of a solid ink, along with a second mass of a solid ink printed in a distraction pattern over or under a portion of the first mass. The distraction pattern has an average thickness that is at least as large as the average thickness of the toner image. The toner image exhibits a property of adhesion to the substrate that is substantially higher than a property of adhesion of the solid ink image, such that the solid ink image may be removed from the substrate by scratching with a hard object without removing the toner layer.

In an alternate embodiment, a method of printing a scratch-off document includes: (i) printing a toner layer by printing, on a substrate, a message made of a plurality of pixels of a first toner; (ii) printing, on the substrate at positions adjacent to the pixels of the message, a background; (iii) printing a first layer of a solid ink onto the toner layer, wherein the first layer has a substantially even thickness; and (iv) printing a second layer of a solid ink over the first layer so that second layer exhibits a distraction pattern, and so that the first layer and the second layer form a scratch-off layer having a textured surface. When printing the solid ink layers, the method may include heating the solid ink to a liquefied state, applying the liquefied solid ink to the substrate over the message, and allowing the liquefied solid ink to cool and return to a solid state before applying a layer over the solid ink layer.

BRIEF DESCRIPTION OF THE DRAWINGS

This patent or application file contains at least one drawing executed in color. Copies of this patent or patent application publication with color drawings will be provided by the Office upon request and payment of the necessary fee.

DETAILED DESCRIPTION

Figure 1:
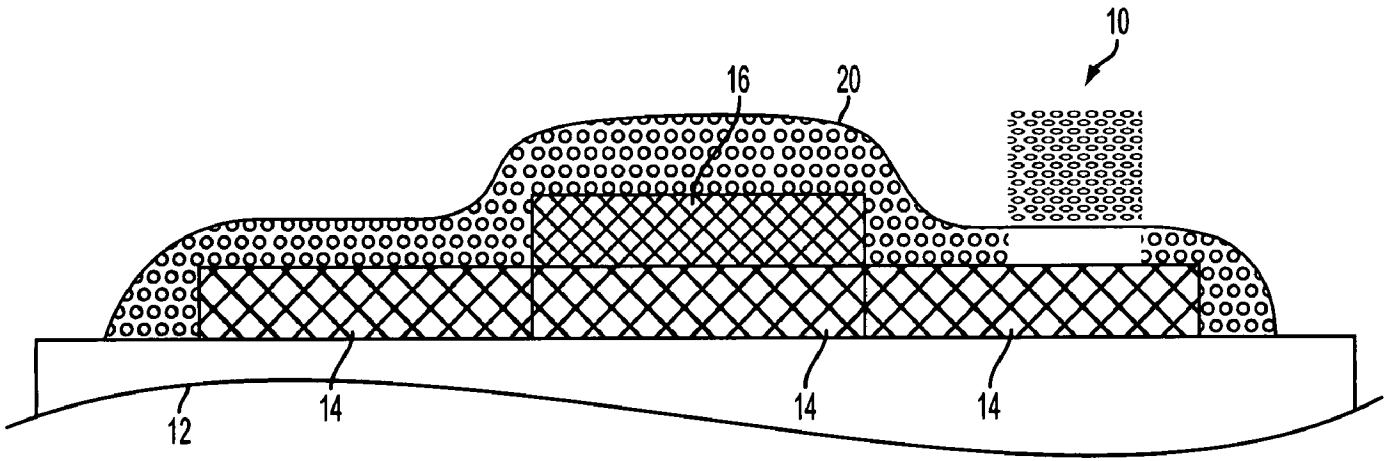
FIG. 1 PRIOR ART
FIG. 1 illustrates a cross-section of an exemplary scratch-off document according to an embodiment.

For the purposes of the discussion below, a "substrate" refers to a document on which printed matter and a scratch-off layer are applied. A substrate may refer to a ticket, sheet of paper, gift card, other document and/or the like.

For the purposes of the discussion below, "ink" refers to the wet or dry material that forms an image or text on a substrate. A "solid ink", or a phase-change ink, is an ink that is a solid at room temperature. Solid inks typically are heated to a molten state and are printed with an ink jet device. Solid inks used in the context of this document are those having a waxy or similar characteristic such that when printed onto a substrate, they form a layer that can be scratched off of the substrate using a modest pressure and hard object such as a coin, in a manner that does not damage the substrate or remove any underlying images that are printed with permanent toner. Suitable solid inks include, without limitation, those described in U.S. Pat. No. 4,254,207; U.S. Pat. No. 4,385,107; U.S. Pat. No. 4,543,313; U.S. Pat. No. 4,891,293; U.S. Pat. No. 4,952,477; U.S. Pat. No. 4,973,539; U.S. Pat. No. 4,990,424; U.S. Pat. No. 5,057,392; U.S. Pat. No. 5,147,747; U.S. Pat. No. 5,166,026; U.S. Pat. No. 6,017,671; U.S. Pat. No. 6,500,594; U.S. Pat. No. 6,383,205; U.S. Pat. No. 6,413,691; U.S. Pat. No. 6,582,896; and U.S. Pat. No. 6,607,864, the disclosures of which are totally incorporated herein by reference. To provide an adhesive property that enables the ink layer to be easily scratched off, the methods and items below may use ink compositions that include a wax component, such as any of those described in U.S. Pat. No. 6,830,860, the disclosure of which is incorporated herein by reference in its entirety.

As used below, a "solid ink image" is a marking or image created by the application of a heated (and thus liquefied) solid ink to a substrate using an ink-jet or other appropriate application process.

As used below, "toner" refers to solid toner particles that are electrostatically transferred or otherwise applied to a substrate, and then fused, such as by a combination of heat and pressure, to melt the toner onto the substrate, and then allowed to re-solidify to form the permanent image on the substrate. As used in this document, the toner selected will exhibit a property of adhesion to the substrate that is substantially higher than the property of adhesion exhibited by the solid ink. In this manner, the solid ink may be scratched off of the document by a person using light or modest pressure and a hard object such as a coin without removing the toner layer.

A layer of ink or toner may refer to a single ink or a combination of different color inks or toners combined to create a color or pattern. A layer of ink or toner may refer to a combination of different color inks or toners arranged as a mixture of the colors, layers of the colors, or a combination of the two. The ink or toner may be printed directly on the substrate. Alternatively, ink or toner may be printed on an intermediate surface such as a drum and then subsequently transferred to the substrate. In various embodiments described below, one or more layers of ink or toner might be applied to a sheet or are on a sheet to which a previous layer of ink or toner has been applied.

FIG. 1 depicts illustrates an exemplary scratch-off layer of a scratch-off document 10 according to an embodiment that is known in the prior art. As shown in FIG. 1, a scratch-off document may include a substrate 12 bearing printed content. In an embodiment, the printed content may include multiple pixels 14 of toner having a first color that is printed as a background. Multiple pixels 16 of toner having a second color are printed over the first pixels 14 in a pattern that reflects text, numbers, symbols and/or a picture that together display a message in a toner image. The first color pixels 14 and the second color pixels 16 have high contrast with each other so that the message is clearly visible and distinguishable from the background.

A scratch-off layer 20 of solid ink is printed over the toner layers to form a solid ink image over the toner image. The scratch-off layer 20 has a thickness that is larger than that of the toner layers, often by a factor of two. As shown, the thickness of the scratch-off layer is substantially even or uniform. For example, the toner layer may have an average thickness of about 5 microns, and the scratch-off layer may have a thickness of about 10 microns. Other thicknesses are possible. In this context, it may be impossible to note that the first toner layer or background image is applied in a way so that the adhesion of the toner 14 and 16 to the substrate 12 is considerably larger than the adhesion of the solid ink layer 20 to at least the toner area 14 and 16.

The scratch-off layer 20 also has a color that is of high opacity with respect to the color of the message layer ink 16, and thus the message layer ink is different in color from, but not obviously visible through, the scratch-off layer 20. For example, in an embodiment the background pixels 14 may be printed using cyan toner and the message layer pixels 16 may be printed using magenta toner. The combination of cyan and magenta make the message appear to be black. The scratch-off layer 20 may be printed using a rich black solid ink, essentially a combination of black and some other solid ink, thus forming an opaque scratch-off layer. The scratch-off system in FIG. 1 has a well known and understood security issue in the fact that the varying toner layer thickness generally results in a surface variation of the scratch-off solid ink layer, despite this layer being thicker than the toner layer.

Figure 2:
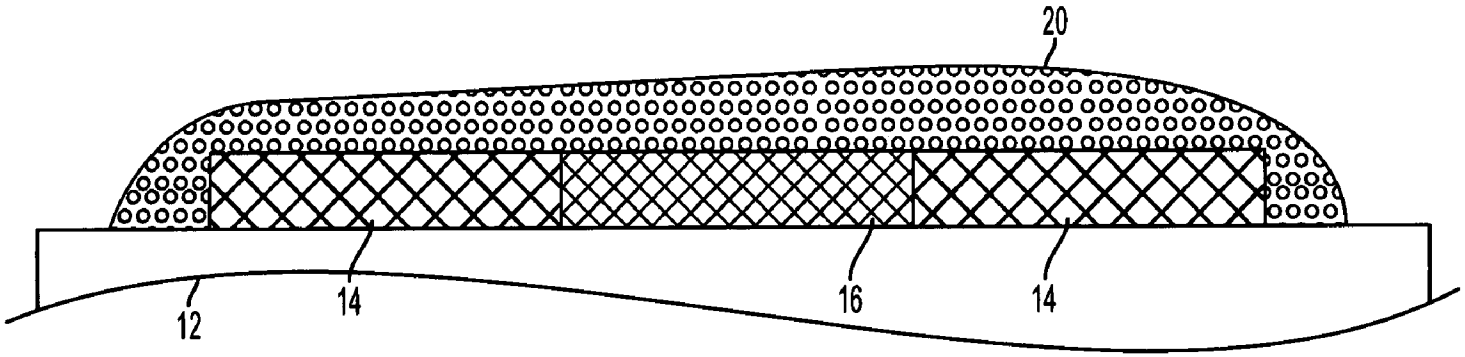
FIG. 2 illustrates a cross-section of an alternate scratch-off layer according to an alternate embodiment.

FIG. 2 illustrates an exemplary scratch-off area of a scratch-off document according to an alternate embodiment. As shown in FIG. 2, the scratch-off document includes a substrate 12 bearing printed content 16 that displays a message. Instead of being printed on top of the background toner pixels 14, the content pixels 16 are printed directly on the substrate 12, alongside the background pixels 14. The messaging, or content, toner pixels 16 may be printed with a pile height that is substantially equal to that of the background toner pixels 14 as shown in FIG. 2. A layer of solid ink 20 is printed over the background and messaging toners, resulting in a scratch-off layer having a smooth coating. When the coating of solid ink is scratched off, the message appears. As with the embodiment of FIG. 1, the scratch-off layer has a color that is of high opacity with respect to the color of the messaging toner 16. The scratch-off layer ink 20 also typically will be of a dark color to hide features of the underlying layer. It is understood that the background pixels 14 and content pixels 16 in themselves might contain a mixture of toners, such as, for example 100% yellow (Y) for the background pixels and 50% cyan (C) and 50% magenta (M) for the content layer, giving 100% layer thickness for background and content pixels. Many more combinations exist that are common in having a predominantly constant layer thickness for background and content pixels, while having a clear visual difference between them.

Figure 3:
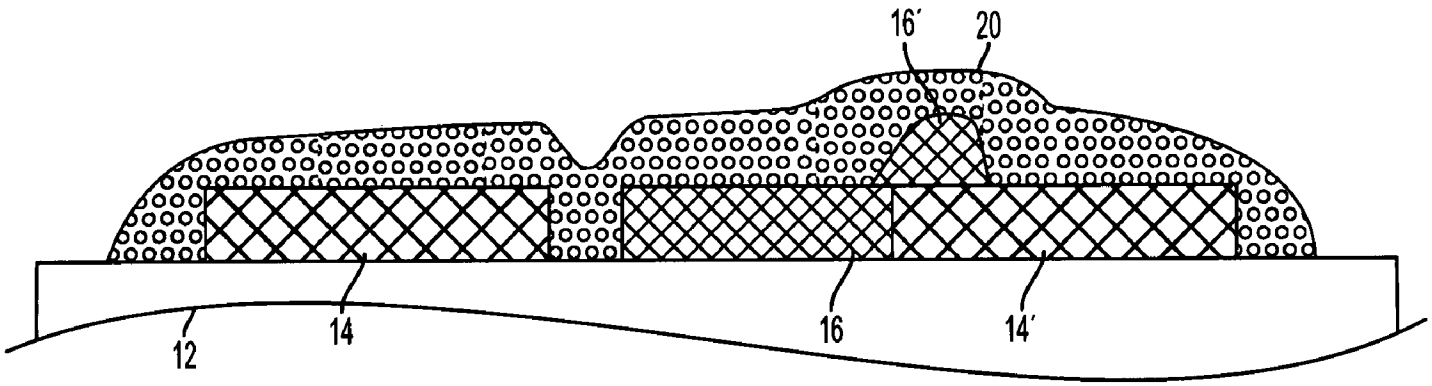
FIG. 3 illustrates a cross-section of an alternate scratch-off layer according to an alternate embodiment.

Referring to FIG. 3, in some embodiments, when the messaging toner 16 is printed alongside the background toner 14, misregistration occurs, and a portion of the messaging layer toner 16' is printed over a portion of the background layer toner 14'. Misregistration is typically not intentional, but occasionally occurs if all parts of a printing device are not in perfect alignment. When this happens, printing the solid ink layer 20 may not precisely conceal the underlying layer, as the misregistration 16 causes the solid ink layer to have a texture corresponding to the various total pile heights of the background/messaging layer.

Figure 4:
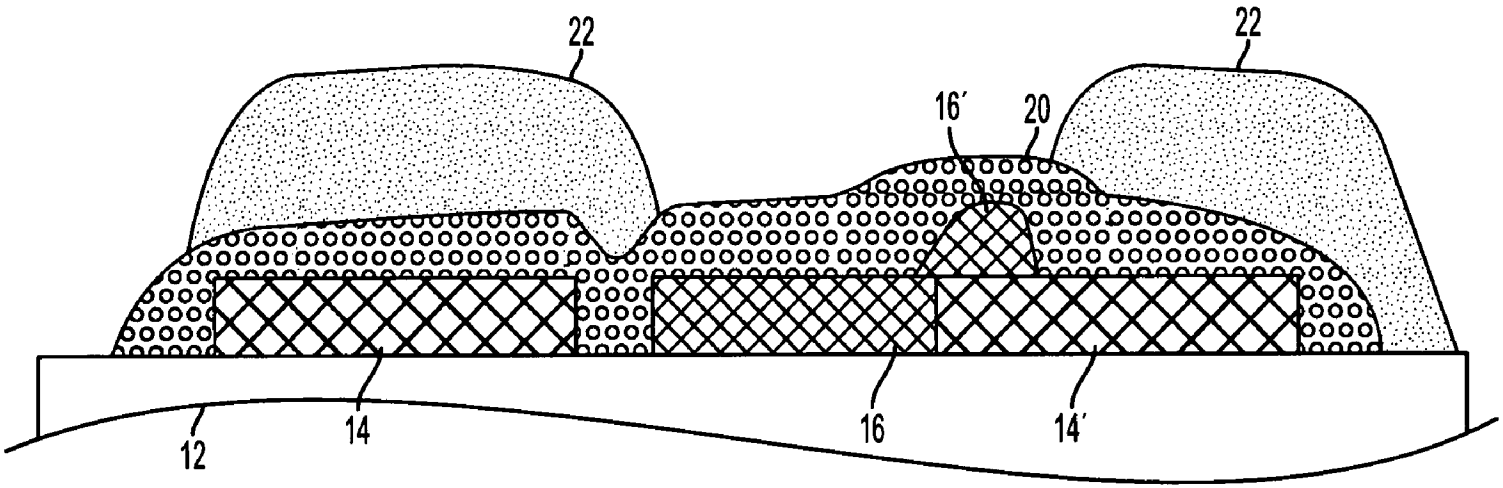
FIG. 4 illustrates a cross-section of an alternate scratch-off layer according to an alternate embodiment.

To help hide a message underneath a scratch-off layer when misregistration occurs, a second solid ink layer may be printed in a distraction pattern over a portion of the first solid ink layer. For example, as shown in FIG. 4, a second solid ink layer 22, is printed over portions of the first solid ink layer 20. The second solid ink layer 22 is printed in a pattern, such as characters, numbers, graphic lines, or another structure so that it does not provide a uniform surface. The color of the second solid ink layer 22 may be the same as that of the first solid ink layer 20. Alternatively, the color of the second solid color ink layer is similar to but not exactly the same as that of the first solid ink layer. For example, the two solid ink layers may be of different shades relating to the same color.

Figure 5:
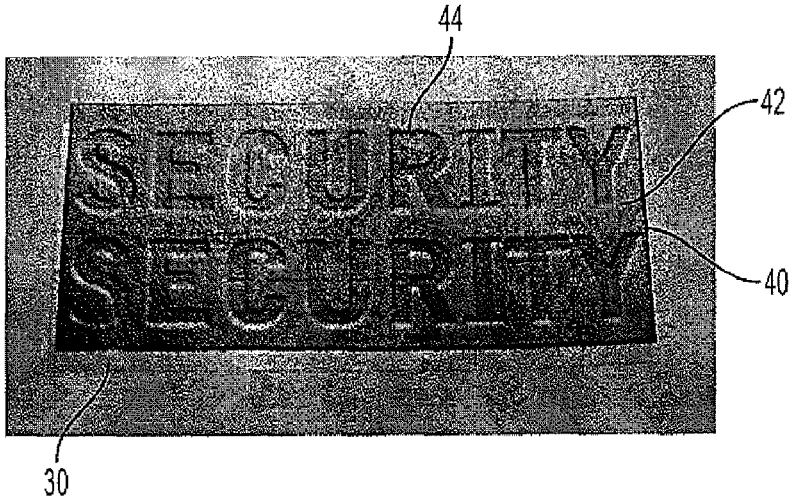
FIG. 5 is an exemplary perspective view of a distraction pattern.

The distraction pattern is a pattern that includes multiple pile heights, and optionally an ink shade that is similar to that of at least one of the underlying layers, so that the pattern distracts the human eye from seeing any variation in pile height of the underlying toner layer. In addition, the pile height of the underlying toner may be varied to the distraction pattern of the scratch off document. An exemplary distraction pattern in shown in FIG. 5, where the background toner layer 30 is shown in yellow as extending from under the gray scratch-off layer 40. The scratch-off layer includes a first solid ink layer 42 that covers the messaging portion of the toner layer, along with a second solid ink layer 44 that does not have a uniform pile height and thus does not fully cover the first solid ink layer 42. In another embodiment, the order of the two solid ink layers may be reversed so that the layer with uniform thickness is on top of the layer of non-uniform thickness. In the example shown, the distraction pattern is the pattern of a repeated word (in this example, the word "security") to distract the human eye so that the human eye focuses on the distraction pattern rather than any variation in pile heights that might exist underneath the distraction pattern. In some embodiments, the average pile height of the second solid ink layer will be greater than that of the toner layer, and in some embodiments at least twice that of the toner layer, so that height variations caused by the distraction pattern are more prominent to the human eye than any height variations that may exist in the underlying toner layer.

Figure 6:
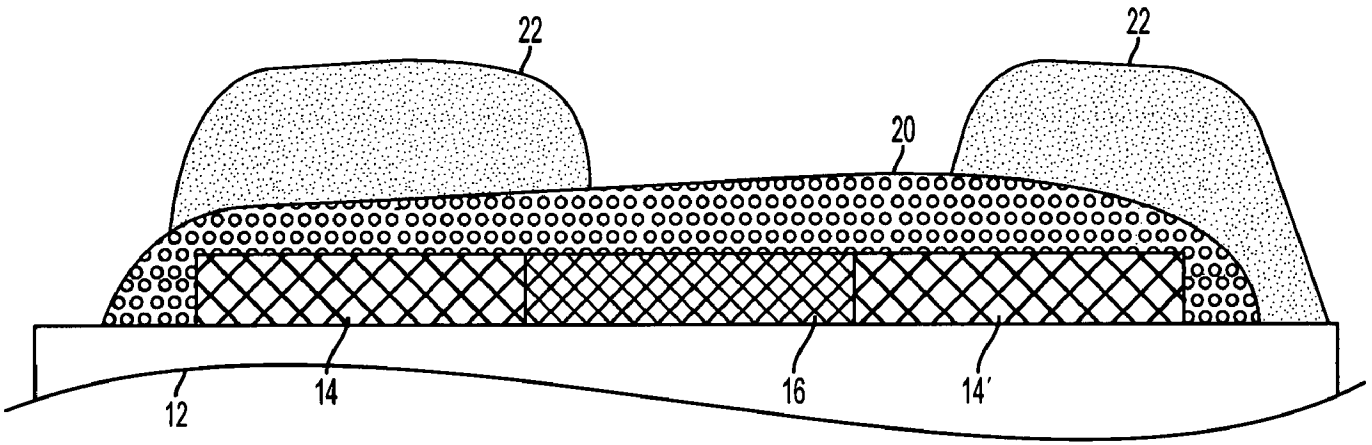
FIG. 6 illustrates a cross-section of an alternate scratch-off layer according to an alternate embodiment.

In this manner, the resulting document includes a combination of a background layer, a messaging layer, a first solid ink layer, and a second solid ink layer that together have a non-smooth texture at the top surface. In this context it is clear that this document's descriptions of the first and second ink layers are functional descriptions and not descriptions of the actual colorants that are deposited. For example, referring again to FIG. 4, the first solid ink layer 20 might consist of 50% black (K) solid ink and the second solid ink layer 22 might consist of 50% K solid ink and 50% cyan (C) solid ink. In the actual printing of the solid ink scratch-off, the printing device would create a uniform layer K of 100% and a structured C layer of 0% or 50%. The functional description of FIG. 4 is used to emphasize the difference in layer thickness and not to indicate the actual layer composition. The non-smooth texture helps to hide any texture variations that are produced by the misregistration 16'. As shown in FIG. 6, printing a distraction pattern of a solid ink 22 over a smooth solid ink layer 20 also can help mask a messaging layer 16 when the messaging layer is printed directly on the substrate without misregistration.

The solid ink of the second layer 22 preferably has a thickness that is at least comparable to that of the first solid ink layer. In other words, the average thickness of the second solid ink layer is preferably at least twice that of the average thickness of the layer containing the message and background (not accounting for extra height of the message layer that may be produced by misregistration).

In various embodiments, each solid ink may be a phase-change ink and/or the like. Phase-change ink may initially be a solid, waxy block that is melted and sent to an ink-jet printhead. The phase-change ink may then solidify once it becomes an image on a substrate.

In some embodiments, the second mass of solid ink 22 may form the pattern of a secondary code, and it may include an infrared active ink that displays the security code when exposed to infrared light. A sensor suitably sensitive to the corresponding infrared wavelengths may be used to detect the security code. The infrared active ink may include a dye based ink. Alternately, the infrared active ink may include a carbon black ink. Additional and/or alternate types of infrared active ink may also be used within the scope of this disclosure. In some embodiments, the first solid ink mass 20 may include an infrared passive ink positioned to partially obscure the security code that is included in the infrared active portion of the second mass.

In an alternate embodiment, the first solid ink 20 may exhibit a first fluorescent signature, and the second solid ink 22 may exhibit a second fluorescent signature, so that when the scratch-off layer is exposed to fluorescent light the security code is displayed. Alternatively, the solid ink that makes up the security code may include a first ink including a first cyan-magenta-yellow-black ("cmyk") metamer and a second ink including a second cmyk metamer which displays the security code when exposed to fluorescent light. Additional and/or alternate types of ink may also be used within the scope of this disclosure.

Figure 7:
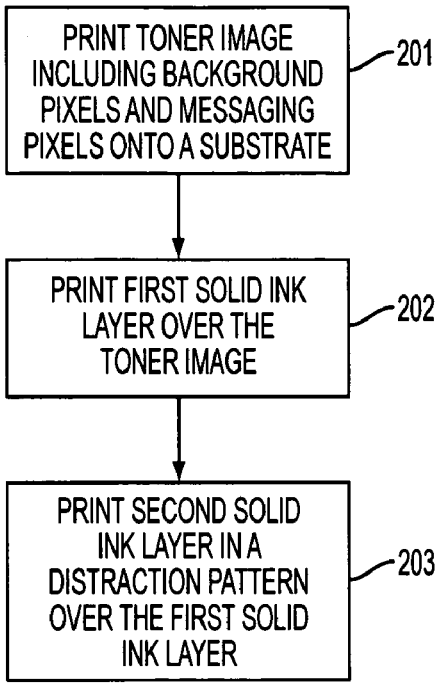
FIG. 7 is a flow diagram of an exemplary method of printing a scratch-off document.

FIG. 7 is a flow diagram of an exemplary method of embedding a security code into a scratch-off document according to various embodiments. As depicted in FIG. 6, a first layer of a toner may be printed 201 onto a substrate to form a toner image. The first layer includes pixels of a background color and pixels of a messaging color. The pixels of a messaging color depict a message and the pixels of a background color fill some or all of the spaces around the messaging pixels. It is understood that the toner layers (14 and 16 of FIGS. 1-6) in themselves might be structured, as long as the structuring between the two elements is preferably not distinguishable through the solid ink layer. For example, both toner layers might be at 70% of maximal toner thickness, or both areas might exhibit the same spatial structure, e.g. a checkerboard. The toner may be applied to an intermediate surface, such as a spinning drum or belt and subsequently transferred from the intermediate surface to a substrate.

Referring back to FIG. 6, a first solid ink layer may be printed 202 onto the toner layer. The first solid ink is made of a material that may be removed from the substrate when it is generated. A second solid ink layer is then printed 203 over a portion of the first solid ink layer in a distraction pattern. Each solid ink layer is applied by heating the ink so that it liquefies, applying the liquefied solid ink to the substrate using an ink-jet or other suitable process, and allowing the solid ink to cool and solidify. Preferably, each solid ink layer is allowed to cool before the second solid ink layer is applied. The solid ink layers together form a solid ink image. The solid ink layers are applied in an amount such that the resulting average thickness of the solid ink image is at least twice that of the average thickness of the toner image.

Some or all of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the disclosed embodiments.

What is claimed is:

1. A scratch-off document comprising:

a substrate;

a toner layer printed on the substrate, the toner layer comprising a plurality of background layer pixels of a toner having a first color and a plurality of messaging layer pixels of a toner having a second color, wherein the first pixels and the second pixels are positioned in a side-by-side relation; and a scratch-off layer covering the toner layer, the scratch-off layer comprising:

a first mass of a first solid ink that covers the messaging layer pixels, a second mass of a second solid ink printed over or under the first mass in a distraction pattern so that the scratch-off layer exhibits a non-uniform pile height and does not provide a uniform surface.

2. The scratch-off document of claim 1, wherein the toner layer exhibits a property of adhesion to the substrate that is substantially higher than a property of adhesion of the scratch-off layer, such that the scratch-off layer may be removed from the substrate by scratching with a hard object without removing the toner layer.

3. The scratch-off document of claim 1, wherein:

the second mass has an average thickness that is greater than an average thickness of the toner layer;

the second solid ink and the messaging layer pixels comprise different shades of the same color; and the distraction pattern distracts the human eye from seeing any variation in pile height of the toner layer.

4. The scratch-off document of claim 1, wherein:

the first solid ink comprises a non-infrared active ink:

the second solid ink comprises an infrared active ink; and the distraction pattern comprises a security code;

so that the second solid ink, when exposed to infrared light, displays the security code.

5. The scratch-off document of claim 1, wherein:

the first mass has an average thickness that is at least twice the average thickness of the toner layer;

the second solid ink and the messaging layer pixels comprise different shades of the same color; and the distraction pattern distracts the human eye from seeing any variation in pile height of the toner layer.

6. The scratch-off document of claim 5, wherein the second mass has an average thickness that is at least twice the average thickness of the toner layer.

7. The scratch-off document of claim 1, wherein the scratch-off layer is substantially opaque.

8. The scratch-off document of claim 1, wherein the toner layer also comprises a distraction pattern.

9. A document comprising:

a substrate;

a toner image printed on the substrate, the toner image comprising a plurality of background layer pixels of a toner having a first color and a plurality of messaging layer pixels of a toner having a second color, wherein the background layer pixels and the messaging layer pixels pixels are positioned in a side-by-side relation so that the toner image exhibits an average thickness; and a substantially opaque solid ink image covering the toner image, the solid ink image comprising:

a first mass of a solid ink that covers the messaging layer pixels, a second mass of a solid ink printed in a distraction pattern over or under at least a portion of the first mass so that the solid ink image exhibits a non-uniform pile height and does not provide a uniform surface, wherein:

the distraction pattern exhibits an average thickness that is at least as large as the average thickness of the toner image, and the second solid ink and the messaging layer pixels comprise different shades of the same color; and wherein the toner image exhibits a property of adhesion to the substrate that is substantially higher than a property of adhesion of the solid ink image, such that the solid ink image may be removed from the substrate by scratching with a hard object without removing the toner layer.

10. The document of claim 9, wherein each of the first mass and the second mass comprise a wax.

11. The document of claim 9, wherein the first mass has an average thickness that is at least twice the average thickness of the toner image.

12. The document of claim 9 wherein:

the first solid ink comprises a non-infrared active ink:

the second solid ink comprises an infrared active ink; and the distraction pattern comprises a security code;

so that the second solid ink, when exposed to infrared light, displays the security code.

13. The document of claim 9, wherein the distraction pattern exhibits an average thickness that is at least twice as large as the average thickness of the toner image.

14. The document of claim 9, wherein:

each of the first mass and the second mass comprise a wax; and the distraction pattern exhibits an average thickness that is at least twice as large as the average thickness of the toner image.

15. The document of claim 14, wherein:

the first solid ink comprises a non-infrared active ink:

the second solid ink comprises an infrared active ink; and the distraction pattern comprises a security code;

so that the second solid ink, when exposed to infrared light, displays the security code.

16. A method of printing a scratch-off document, the method comprising:

printing a toner layer by:

printing a message on a substrate, the message comprising a plurality of pixels of a first toner, and printing a background on the substrate at positions adjacent to the pixels of the message;

printing a first layer of a solid ink onto the toner layer, wherein the first layer has a substantially even thickness; and printing a second layer of a solid ink over the first layer so that second layer exhibits a distraction pattern, so that the first layer and the second layer form a scratch-off layer having a textured surface.

17. The method of claim 16 wherein:

the printing of the first layer comprises printing the first layer at an average thickness that is at least double the thickness of the toner layer; and the printing of the second layer comprises printing the second layer at an average thickness that is at least equal to the thickness of the toner layer.

18. The method of claim 16, wherein the printing of the toner layer comprises printing the toner layer in a distraction pattern.

19. The method of claim 15, wherein the printing the first layer comprises:

heating a first solid ink to a liquefied state;

applying the liquefied first solid ink to the substrate over the message; and allowing the liquefied first solid ink to cool and return to a solid state before applying the second layer.

20. The method of claim 19, wherein the printing the second layer comprises:

heating a second solid ink to a liquefied state;

applying the liquefied second solid ink to the substrate over the first solid ink; and allowing the liquefied second solid ink to cool and return to a solid state.

* * * * *